US011480926B2

(12) United States Patent
Christan

(10) Patent No.: US 11,480,926 B2
(45) Date of Patent: Oct. 25, 2022

(54) BALANCE-SPRING STUD FOR FIXING A SPIRAL SPRING OF A TIMEPIECE MOVEMENT AND METHOD FOR MANUFACTURING SUCH A BALANCE-SPRING STUD

(71) Applicant: ETA SA Manufacture Horlogere Suisse, Grenchen (CH)

(72) Inventor: Julien Christan, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 832 days.

(21) Appl. No.: 16/379,009

(22) Filed: Apr. 9, 2019

(65) Prior Publication Data

US 2019/0346812 A1 Nov. 14, 2019

(30) Foreign Application Priority Data

May 14, 2018 (EP) ..... 18172195

(51) Int. Cl.
*G04B 17/32* (2006.01)

(52) U.S. Cl.
CPC ..... *G04B 17/325* (2013.01)

(58) Field of Classification Search
CPC ..... G04B 17/325
See application file for complete search history.

(56) References Cited

U.S. PATENT DOCUMENTS 3,842,592 A * 10/1974 Giger ..... G04B 17/325 368/178
2017/0017204 A1* 1/2017 Stranczl ..... G04B 17/34
2017/0248918 A1* 8/2017 Christan ..... G04B 17/325

FOREIGN PATENT DOCUMENTS

CH 622 149 3/1981
CH 622149 A * 3/1981 ..... G04B 17/325
FR 2.051.170 4/1971
FR 2051170 A5 * 4/1971 ..... G04B 17/325
FR 2141622 A1 1/1973

(Continued)

OTHER PUBLICATIONS

Japanese Office Action dated Dec. 15, 2020 in Japanese Patent Application No. 2019-065797 (with English Translation), 4 pages.

(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

A balance-spring stud for fixing with a spot of glue a free end of a last turn on the outside of a spiral spring for a timepiece movement, this balance-spring stud includes a base within a plane, first and second arms extending from the plane and free at their end opposite the base, the first and second arms being separated from one another by a gap in which the free end of the last turn on the outside of the spiral spring that is trapped in the hardened spot of hardened glue is housed, at least one of the first and second arms being provided with a stop device arranged to prevent the spot of hardened glue in which the free end of the last turn on the outside of the spiral spring is trapped from being released from the gap in which the spot of hardened glue is housed when this spot of hardened glue no longer adheres to the balance-spring stud.

3 Claims, 8 Drawing Sheets

(56) References Cited

FOREIGN PATENT DOCUMENTS

| | | | | |
|---|---|---|---|---|
| FR | 2283475 | A1 | 3/1976 | |
| FR | 2 352 332 | | 12/1977 | |
| FR | 2352332 | A1 * | 12/1977 | ..... G04B 17/325 |
| JP | 52-1172 | U | 1/1977 | |

OTHER PUBLICATIONS

European Search Report dated Dec. 19, 2018 in European Application 1817295.2 filed on May 14, 2018 (with English translation of categories of Cited Documents).
Combined Chinese Office Action and Search Report dated Sep. 3, 2020 in Chinese patent Application No. 201910393205.3 (with English translation of the Office Action and English translation of Category of Cited Documents), 10 pages.
Japanese Office Action dated Mar. 17, 2020 in Japanese Patent Application No. 2019-065797, 7 pages.

* cited by examiner

BALANCE-SPRING STUD FOR FIXING A SPIRAL SPRING OF A TIMEPIECE MOVEMENT AND METHOD FOR MANUFACTURING SUCH A BALANCE-SPRING STUD

CROSS-REFERENCE TO RELATED APPLICATION

This application claims priority to European Patent Application No. 18172195.2 filed on May 14, 2018, the entire disclosure of which is hereby incorporated herein by reference.

TECHNICAL FIELD OF THE INVENTION

The present invention relates to a balance-spring stud for fixing a spiral spring of a timepiece movement. More precisely, the present invention relates to a balance-spring stud in which a last turn on the outside of a spiral spring of a timepiece movement is fixed by adhesive bonding. The invention also relates to a method for manufacturing such a balance-spring stud.

TECHNOLOGICAL BACKGROUND OF THE INVENTION

In the field of horology, a spiral spring associated with a balance forms a time base for the mechanical timepieces. In a first approach, the spiral spring is in the form of a very fine spring wound in concentric turns. A first end of the spiral spring, referred to as the first turn on the inside, is fixed to a collet, and a second end of the spiral spring, referred to as the last turn on the outside, is fixed to a balance-spring stud.

More precisely, the time base for mechanical timepieces, also referred to as an oscillating system, comprises a balance/spiral spring pair and an escapement. The balance is composed of a balance staff pivoted between a first and a second bearing and connected to a balance rim by means of radial arms. The spiral spring is fixed via its first turn on the inside to the staff of the balance, for example by means of a collet. The spiral spring is fixed via its last turn on the outside to an attachment point formed by a balance-spring stud carried by a balance-spring stud holder where applicable. As for the escapement, this comprises a double-plate system consisting of a large plate that carries a plate pin and a small plate in which a notch is formed. The escapement also comprises pallets, a pallet staff of which is pivoted between a first and a second bearing. The pallets are composed of a lever that connects a fork to an input arm and to an output arm. The fork consists of an input horn and an output horn between which a dart extends. The movement of the fork is limited by an input limitation pin and an output limitation pin, which can be made in a single piece with a pallet bridge. The input arm and the output arm carry respectively an input pallet stone and an output pallet stone. Finally, the pallets cooperate with an escapement wheel comprising an escapement wheel staff pivoted between a first and a second bearing.

The spiral spring is in the form of a spiral wound in a horizontal plane, parallel to the plane of the timepiece movement. It serves only one function: once associated with a balance, it must turn in one direction and then in the other, that is to say oscillate about its equilibrium position at a frequency that is as constant as possible. It is said that the spiral spring breathes. However, everything contributes to preventing a spiral spring from always oscillating at the same frequency. The spiral spring must in particular withstand the oxidation and magnetism that stick the turns together and stop the watch. The influence of atmospheric pressure, on the other hand, is small. For a long time it is the temperature that has been the heart of the problem, since heat expands the metal, while cold shrinks it. The spiral spring must also be elastic so as to deform and nevertheless always regain its shape.

The material used for producing spiral springs is normally a steel. Ductile, such an alloy must resist corrosion. Recent developments propose producing spiral springs from silicon. Silicon spirals, in particular because they are insensitive to magnetism, are more precise than their steel predecessors. On the other hand, their cost price is higher and they are more difficult to assemble.

A spiral spring must be isochronous. No matter to what point the spiral spring turns, it must always take the same time to oscillate. If the spiral spring contracts by only a few degrees, it accumulates little energy and slowly returns to its equilibrium position. If the spiral spring is moved away far from its equilibrium position, it very quickly moves in the opposite direction. The important thing is that these two movements take place in the same period of time. The underlying idea is that the energy that the spiral spring has is not constant and that it must despite everything function whether the watch is completely wound up or is in its last hours of running reserve.

Because of their small dimensions, spiral springs are difficult to assemble. However, the way in which the two ends of the spiral spring are fixed also has a great of influence on the precision of the running of the timepiece movement. In the majority of mechanical timepiece movements, the two ends of the spiral spring are inserted in a pierced part and are immobilised by means of a pin force-fitted manually by means of pliers. A slight rotation of the spiral spring may then occur, which is detrimental to the precision of the running of the movement. To overcome this problem, the French timepiece manufacturer Lip, during the 1960s, proposed to bond a spiral spring with a grain of hot-melt glue, that is to say a glue that is hard at ambient temperature, but melting under the action of heat.

Nevertheless, even the technique consisting of bonding the end of the spiral springs by means of a hot-melt glue showed its limits. It has in fact been observed that, because of its viscosity, hot-melt glue, in melting, exerts by capillarity a traction force on the spiral spring and may press the end of the spiral spring against the walls of the balance-spring stud in which this end is engaged. The resulting deformation of the spiral spring causes mechanical stresses in it that are highly detrimental to the regularity of its running.

To remedy these problems, the applicant has already proposed a method for fixing a spiral spring that does not cause any mechanical stress in such a spiral spring and does not move it away from its idle position. This method consists of bonding the last turn on the outside of a spiral spring in a balance-spring stud by means of a drop of fluid glue polymerisable for example by means of ultraviolet radiation. Thus, even if, at the time the drop of glue is deposited, for example by means of a glue dispenser of the syringe type, the free end of the last turn of the spiral spring moves a little under the effect of the weight of the drop of glue, which causes undesired mechanical stresses in the spiral spring, the glue is, before hardening, sufficiently fluid to enable the free end of the last turn of the spiral spring to spontaneously regain its idle position. The mechanical stresses caused in the spiral spring at the moment of the deposition of the drop of liquid glue therefore disappear themselves, so that the regularity of the running of the spiral spring is not affected by the operation of bonding the latter.

The above solution thus makes it possible to fix a spiral spring by the free end of its last turn on the outside in a balance-spring stud while totally or at least for the major part eliminating the mechanical stresses that are normally caused in such a spiral spring during assembly thereof. The regularity of running of the spiral spring is thus greatly improved thereby. With use, the applicant nevertheless realised that the spot of hardened glue formed when the drop of liquid glue used to fix the free end of the last turn on the outside of the spiral spring is polymerised sometimes had a tendency to become disconnected from the balance-spring stud, which of course causes the immediate failure of the timepiece movement in which this spiral spring is installed. Such a situation in which the spot of glue in which the free end of the last turn on the outside of the spiral spring is trapped becomes detached from the balance-spring stud is in particular due to problems of surface finish of the balance-spring stud that prevent the spot of glue from adhering perfectly to the balance-spring stud.

SUMMARY OF THE INVENTION

The aim of the present invention is to solve the aforementioned problems as well as yet others by procuring a novel type of balance-spring stud the shape of which makes it possible to guarantee that the spot of glue in which the free end of the last turn on the outside of the spiral spring is trapped will not become disconnected from the balance-spring stud even if this spot of glue no longer adheres to the balance-spring stud.

To this end, the present invention relates to a balance-spring stud used for fixing a free end of a last turn on the outside of a spiral spring for a timepiece movement, this balance-spring stud comprising a base that lies in a plane and on which a first arm and a second arm that are free at their end opposite to the base are erected, the first and second arms being separated from one another by a gap in which the free end of the last turn on the outside of the spiral spring that is trapped in a hardened spot of glue is housed, at least one of the first and second arms being provided with a stop means arranged to prevent the spot of glue in which the free end of the last turn on the outside of the spiral spring is trapped from being released from the gap in which it is housed when this spot of glue no longer adheres to the balance-spring stud.

According to a particular embodiment of the invention, at least one of the first and second arms is pierced right through with a hole.

According to another particular embodiment of the invention, at least the first arm is free at its end opposite to the base, and comprises a groove at a distance from its free end, this groove lying in a plane that forms an angle with the plane of the base.

According to yet another particular embodiment of the invention, the stop means projects into the gap designed to receive the spot of hardened glue in which the free end of the last turn on the outside of the spiral spring is trapped.

According to yet another particular embodiment of the invention, the stop means is at least one bead that is made in one piece with the corresponding arm of the balance-spring stud.

As a result of these features, the present invention procures a balance-spring stud used to fix the free end of the last turn on the outside of a spiral spring for a timepiece movement, this balance-spring stud being provided with a stop means designed to prevent the spot of glue in which the free end of the last turn on the outside of the spiral spring is trapped from disengaging from the gap in which this spot is housed when the latter is no longer adhering to the balance-spring stud.

The present invention applies to all types of known spiral spring. It may in particular be metal spirals typically produced from steel. It may also be spiral springs produced from silicon.

The present invention is also not limited to any type of glue in particular. This is because the free end of the last turn on the outside of the spiral spring may for example be bonded in the gap of the balance-spring stud by means of the adhesive well known by its name "Lacquer gum" (adhesive known by the same name or under the name "Shellac" in English terminology), or be bonded by means of a liquid glue which can for example be polymerised by means of UV radiation. The advantage of lacquer gum lies mainly in the fact that it adheres well and lastingly to the balance-spring stud. On the other hand, to the knowledge of the applicant, the bonding of spirals to balance-spring studs by means of a lacquer glue has never been automated and the success thereof remains entirely dependent on the dexterity of the operator responsible for this operation. Lacquer gum is a resin and the operator takes a small flake of it, which he places in the gap intended to receive the free end of the last external turn of the spiral spring. After having placed this end of the spiral spring in the gap in the balance-spring stud, the operator briefly heats the flake of lacquer gum, which melts and traps the free end of the last external turn of the spiral spring. The operator next leaves the lacquer gum to cool and, after a visual check, decides whether it is necessary to add an additional quantity of lacquer gum or whether he can pass to the following spiral spring/balance-spring stud assembly. It will be understood that such a succession of operations is difficult to automate. This is why it has been proposed to glue the spiral springs, in particular those produced from silicon, by means of a liquid glue polymerisable by means of UV radiation or able to harden in contact with air. As already mentioned above, the fluidity of such a type of glue is such that, after deposition of a drop of this glue, the free end of the last external turn of the spiral spring can spontaneously return to its idle position from which it has been moved apart during the deposition of the glue. In particular, the quantity of liquid glue deposited can be controlled very precisely and fully automated by means of a glue dispenser such as a syringe, also known by the English term dispenser. After deposition of the drop of liquid glue, the latter is hardened by insolation by means of a UV lamp. It will be understood well that such a method is easily automatable. On the other hand, the drawback of photopolymerisable glue is that adhesion thereof to the balance-spring stud is not very satisfactory and that the risks that the spot of glue in which the free end of the last turn on the outside of the spiral spring is trapped may become detached from the balance-spring stud are high.

It is to respond to these problems that the present invention proposes providing a timepiece balance-spring stud with a stop means for preventing the spot of glue in which the free end of the last turn on the outside of the spiral spring is trapped from becoming detached from this balance-spring stud. The balance-spring stud is typically in the form of a base that lies in a plane from which two arms separated from one another by a gap designed to receive the free end of the last turn on the outside extend. The stop means may take various forms, among which mention can be made non-limitatively of a hole that passes right through at least one of the two arms. Once the free end of the last turn on the outside of the spiral spring is positioned in the gap in the balance-spring stud, the drop of liquid glue is deposited. By capillarity, the latter will in particular diffuse in the hole, in which it will remain captive, and harden after insolation by means of UV radiation. Consequently if, over time, the spot of glue becomes disconnected from the balance-spring stud, it will however not manage to become released from the gap in which it is housed, so that this will have no effect on the functioning of the timepiece movement.

The stop means may also be provided in the form of an element, for example a bead, projecting in the gap in the balance-spring stud in which the free end of the last turn on the outside of the spiral spring is housed. In this case also, if the spot of glue in which the free end of the spiral spring is trapped becomes disconnected from the balance-spring stud, this spot of hardened glue will not be able to escape from the gap.

According to yet another particular embodiment of the invention, at least one of the first and second arms of the balance-spring stud comprises a groove that lies in a plane that forms an angle with the plane of the base. This groove delimits a hook that serves as a stop means for the spot of glue.

The invention also relates to a method for manufacturing a balance-spring stud used for fixing a free end of a last turn on the outside of a spiral spring for a timepiece movement, this balance-spring stud comprising a base that lies in a plane and a first and second arm that extend from this plane, the first and second arms being separated from one another by a gap in which the free end of the last turn on the outside of the spiral spring that is trapped in a spot of hardened glue is housed, the gap being initially produced with a first width, the method comprising the step that consists of widening the gap by stamping and creating, by upsetting, a stop means that projects in the gap designed to receive the spot of hardened glue in which the free end of the last turn on the outside of the spiral spring is trapped.

BRIEF DESCRIPTION OF THE FIGURES

Other features and advantages of the present invention will emerge more clearly from the following detailed description of an example embodiment of a balance-spring stud according to the invention, this example being given purely for illustration and solely non-limitatively in relation to the accompanying drawing, on which.

DETAILED DESCRIPTION OF AN EMBODIMENT OF THE INVENTION

The present invention proceeds from the general inventive idea that consists of providing a balance-spring stud intended for fixing a spiral spring of a timepiece movement with a stop means designed to prevent a free end of the last turn on the outside of the spiral spring from becoming uncoupled from the balance-spring stud and causing immediate stoppage of the timepiece movement. More precisely, the balance-spring stud comprises a base that lies in a plane from which first and second arms extend, separated from one another by a gap. This gap is designed to receive the free end of the last turn on the outside of the spiral spring, which will be immobilised by means of a spot of glue hardened by ultraviolet radiation. In accordance with the invention, at least one of the two arms of the balance-spring stud is provided with a stop means designed to prevent the spot of glue, and therefore the free end of the turn on the outside of the spiral spring, from escaping from the gap should the spot of glue become disconnected from the balance-spring stud. This stop means may be in various forms such as, non-limitatively, a hole, a bead or a hook.

In the following detailed description of several particular embodiments of the invention, the gluing of a silicon spiral by means of a liquid glue intended to be polymerised by means of ultraviolet radiation will be dealt with. It will however be understood that the invention is not limited to this particular embodiment and that it applies identically to any type of spiral spring such as metal spiral springs produced for example by means of a steel alloy.

Figure 1A:
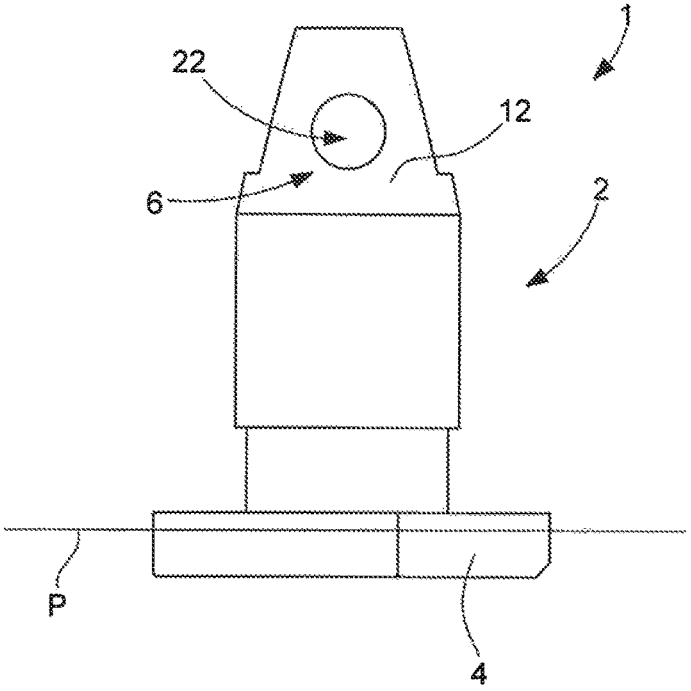
FIGS. 1A and 1B are views respectively in elevation and perspective of a first embodiment of the invention in which the first and second arms of the balance-spring stud according to the invention are pierced with a through hole.
Figure 1B:
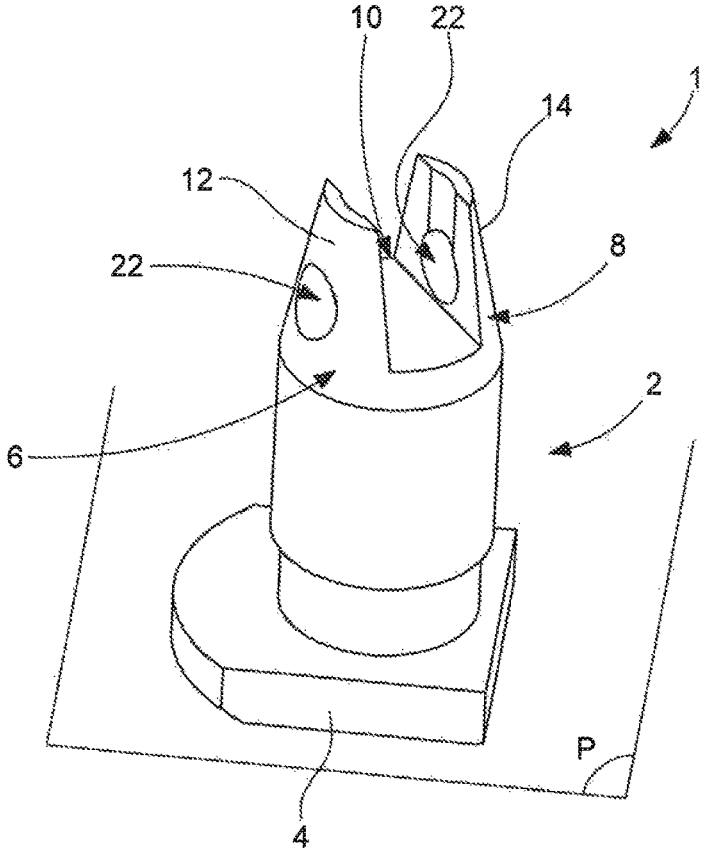

Designated overall by the numerical reference 1, a first particular embodiment of a balance-spring stud 2 according to the invention is shown in FIGS. 1A and 1B appended to the present patent application. As can be seen from an examination of these two FIGS. 1A and 1B, the balance-spring stud 2 comprises a base 4 that lies in a plane P on which a first arm 6 and a second arm 8, which are free at their end opposite to the base 4, are erected. In the example shown in the drawing, the first and second arms 6 and 8 extend perpendicular to the plane P of the base 4 and are separated from one another by a substantially parallelepipidal gap 10. Still in FIGS. 1A and 1B, it can be seen that the external surfaces 12 and 14 of the first and second arms 6 and 8, that is to say the surfaces of these two arms 6 and 8 that do not delimit the gap 10, have a tendency to converge towards one another as these two arms 6 and 8 move away from the base 4, so that it will immediately be understood that, if the gap 10 were filled in and the two arms 6 and 8 joined to one another, these two arms 6 and 8 would fit in an external envelope frustoconical in shape. This geometry for the balance-spring stud 2 is preferred in particular for reasons of compactness and ease of adjustment of the regulator (not shown) that forms part of the timepiece movement. Nevertheless, this geometry is in no way imposed by the requirements of the invention and other external forms of the balance-spring stud 2 can be envisaged without departing from the scope of the invention defined in the claims.

In accordance with the invention, the balance-spring stud 2 is provided with a stop means designed to prevent a spot of glue 16 in which a free end 18 of a last turn on the outside of a spiral spring 20 is trapped from escaping from the gap 10 in the case where the spot of glue 16 becomes disconnected from the balance-spring stud 2. According to the first particular embodiment 1 of the invention, this stop means is in the form of a hole 22 pierced right through in at least one of the first and second arms 6, 8. In the example illustrated in FIGS. 1A, 1B, a hole 22 is pierced in each of the two arms 6 and 8.

Figure 6A:
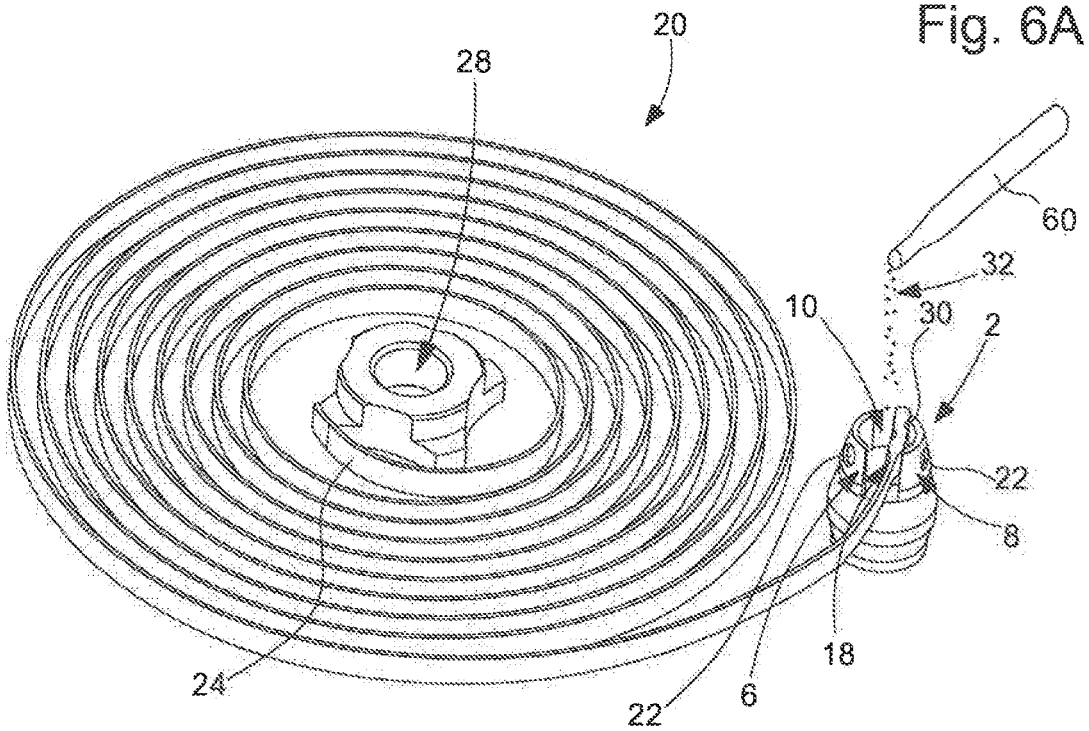
FIGS. 6A and 6B illustrate schematically the method for bonding the free end of the last turn on the outside of the spiral spring to the balance-spring stud by means of a spot of glue.
Figure 6B:
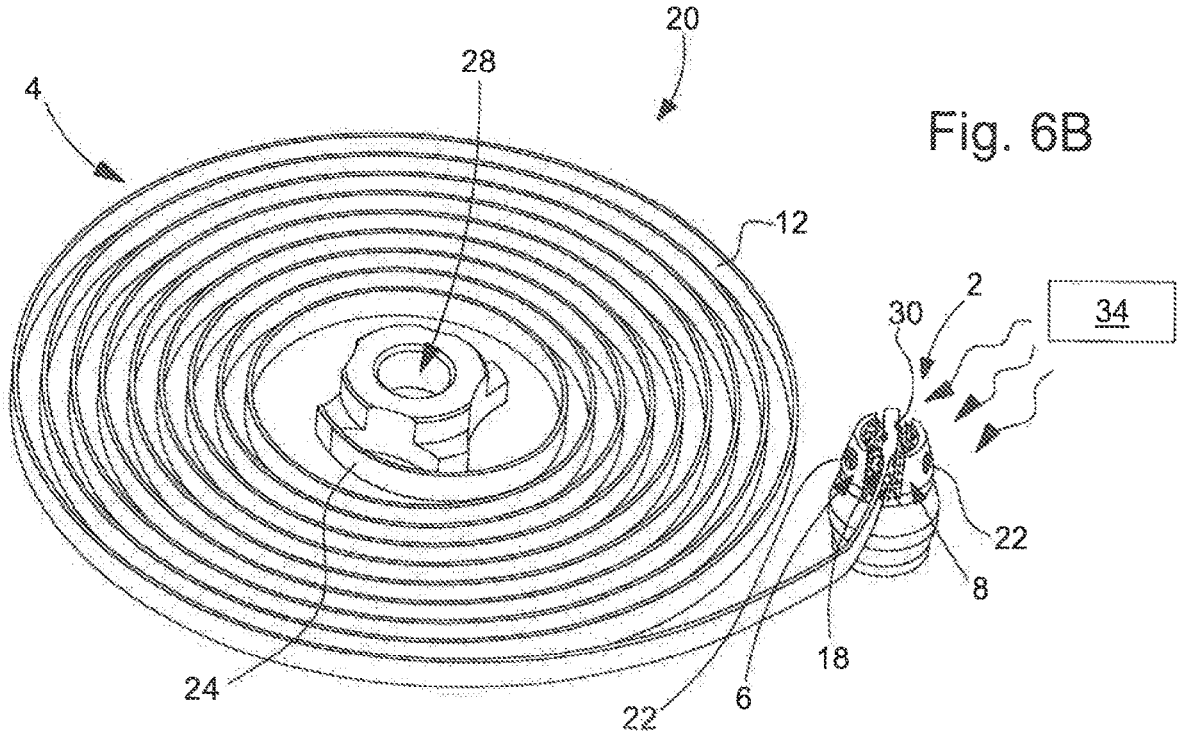

The example of a silicon spiral spring 20 more particularly visible in FIGS. 6A and 6B conventionally consists of a very fine spring wound in concentric turns and the cross section of which is constant over substantially the entire length thereof. This spiral spring 20 is fixed via a free end 24 of a first turn on the inside to a balance staff of the timepiece movement (not shown) for example by means of a collet 28, and via the free end 18 of its last turn on the outside to the balance-spring stud 2 according to the invention. For this purpose, the last turn on the outside of the spiral spring 20, slightly thicker than the other turns over part of its length, can be provided at its free end 18 with a disc 30 made in a single piece with the spiral spring 20. The presence of the disc 30 is dictated by considerations particular to the technique for manufacturing silicon spiral springs 20 solely. It is important to understand that the presence of this disc 30 is in no way made necessary by the requirements of the present invention and that it is entirely possible to fix a spiral spring with no such disc to the balance-spring stud 2 according to the invention.

Figure 1C:
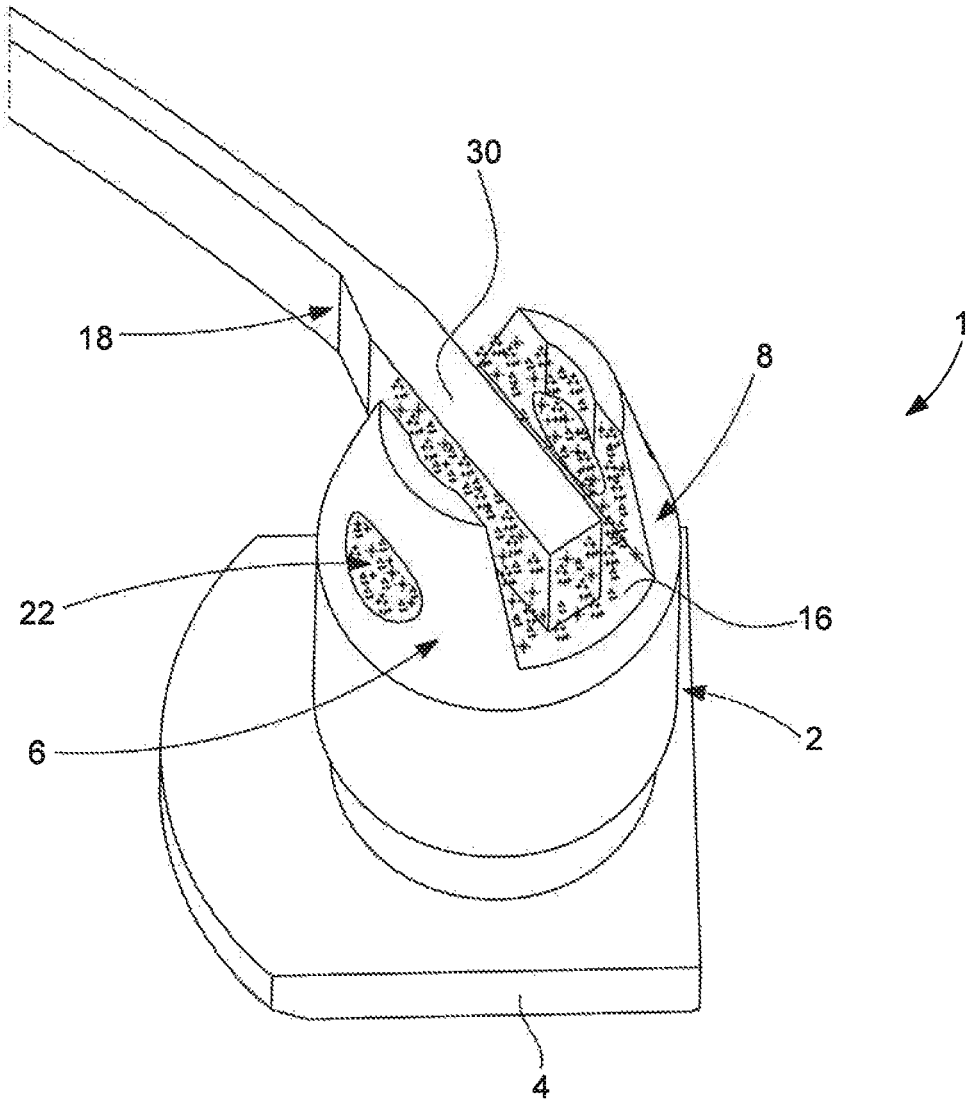
FIG. 1C is a view similar to the one in FIG. 1B, on which a silicon spiral spring can be seen, the free end of the last turn on the outside of which is fixed to the balance-spring stud by means of a spot of glue.

In the example illustrated in FIGS. 1A to 1C, a hole 22 is pierced right through in each of the two arms 6 and 8. Thus, when the liquid glue is deposited in the gap 10, it diffuses in the holes 22 by capillarity, holes 22 in which the liquid glue will remain trapped and harden after insolation by means of UV radiation or in contact with the air. Thus a spot of glue 16 forms, in which the free end 18 of the last turn on the outside of the spiral spring 20 is trapped. Consequently if, over time, the spot of glue 16 comes to be disconnected or unstuck from the balance-spring stud 2, it will nevertheless not come to be disengaged from the gap 10 in which it is housed and to be uncoupled from the balance-spring stud 2 according to the invention, so that this will have no repercussions on the functioning of the timepiece movement. This is because the spot of glue 16 will not become disengaged from the gap 10, in particular in the region where the liquid glue has hardened in the holes 22.

Hereinafter, the elements identical to those described in relation to FIGS. 1A to 1C will be designated by the same numerical references.

Figure 2A:
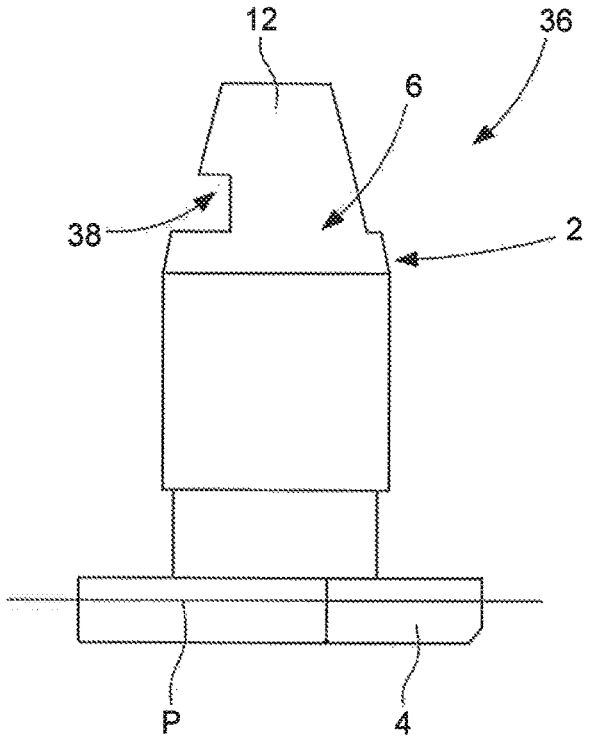
FIGS. 2A, 2B and 2C are views in elevation and perspective of a second embodiment of the invention in which a groove machined in the first and second arms of the balance-spring stud according to the invention delimits two hooks.
Figure 2B:
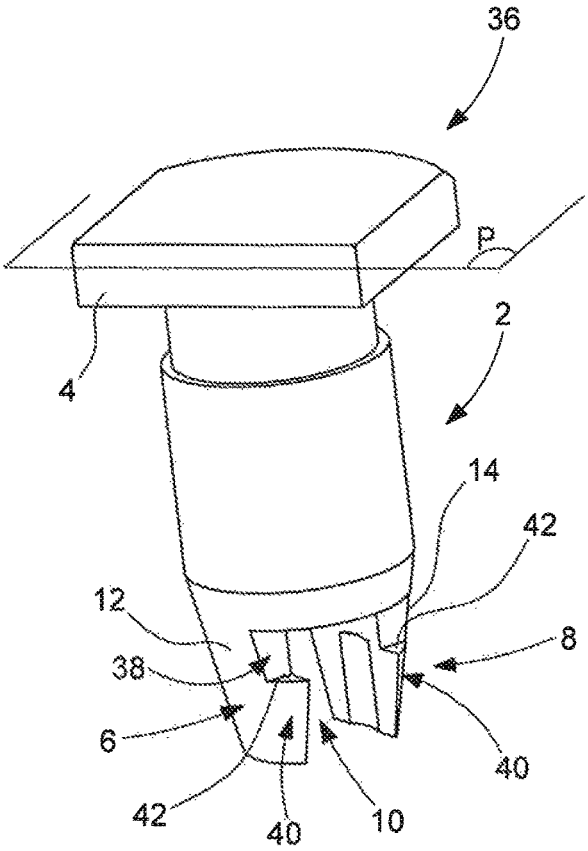
Figure 2C:
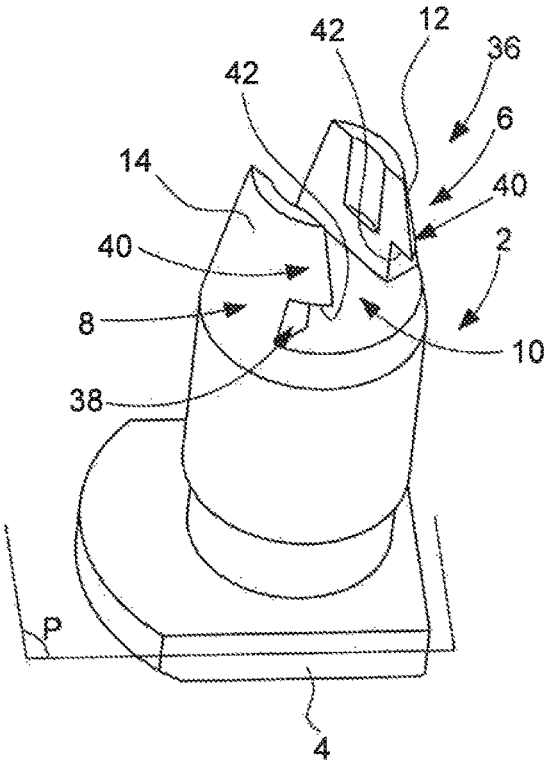

Designated overall by the general numerical reference 36, a second particular embodiment of a balance-spring stud 2 according to the invention is shown in FIGS. 2A to 2C appended to the present patent application. In accordance with this second embodiment 36, a groove 38 that extends in a plane that forms an angle with the plane P of the base 4 is machined in at least one of the first and second arms 6, 8. In the example illustrated in FIGS. 2A to 2C, the groove 38 is machined in the two arms 6 and 8 and extends in a plane perpendicular to the plane P of the base. Thus machined, the groove 38 delimits, for each of the first and second arms 6 and 8, a hook 40 which, once the spot of glue 16 has hardened, for example by insolation by means of UV radiation or in contact with the air, will hold the resulting spot of glue 16 and prevent it from becoming released from the gap 10 in the case where the spot of glue 16 becomes disconnected from the balance-spring stud 2. This is because, combined with the recess formed by the groove 38, the hooks 40 form two support surfaces 42 on which the liquid glue will be deposited by capillarity before hardening in order to form the spot of glue 16 and which will prevent any possible withdrawal of this spot of glue 16.

Figure 2D:
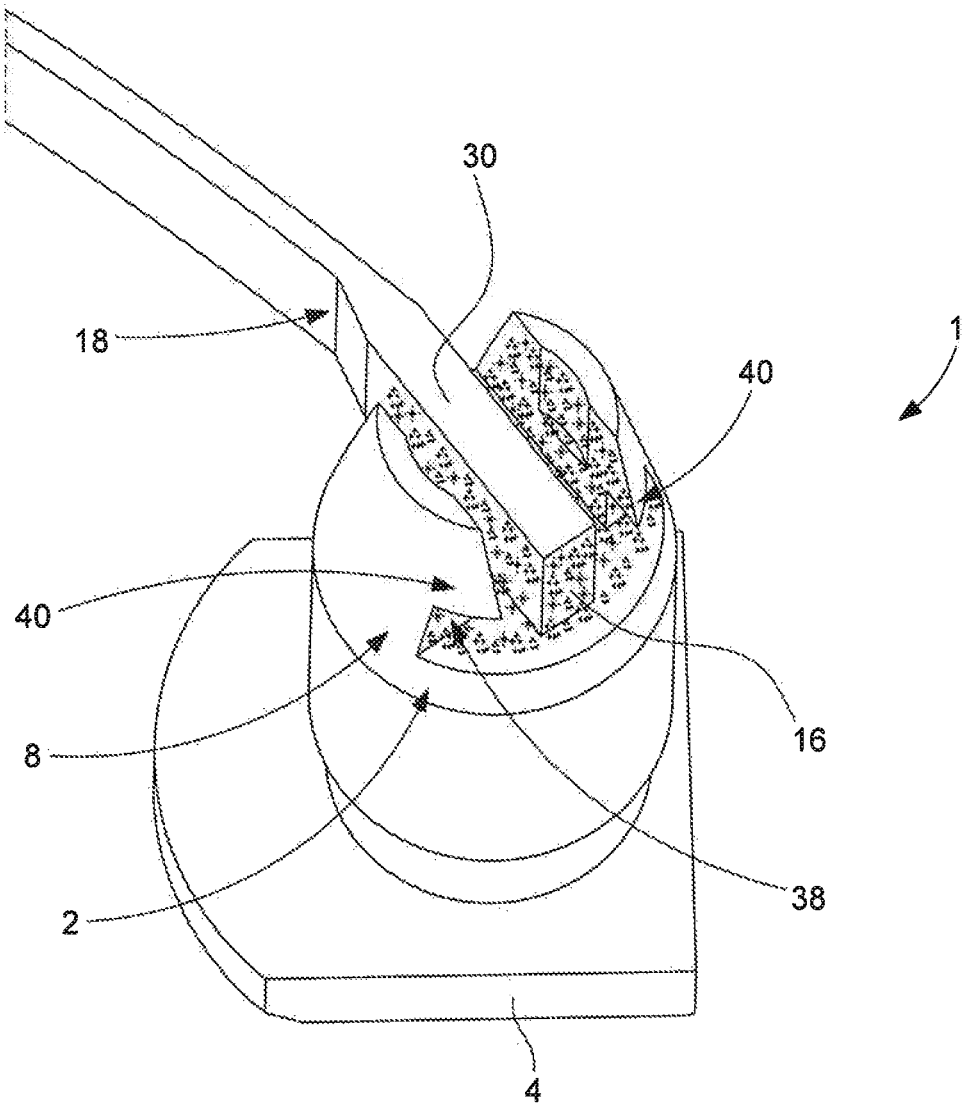
FIG. 2D is a view similar to the one in FIG. 2C, on which a silicon spiral spring can be seen, the free end of the last turn on the outside of which is fixed to the balance-spring stud by means of a spot of glue.

FIG. 2D is a view similar to those in FIGS. 2A to 2C, in which the silicon spiral spring 20 can be seen, fixed to the balance-spring stud 2 by the free end 18 of its last turn on the outside by means of a spot of glue 16.

Figure 3A:
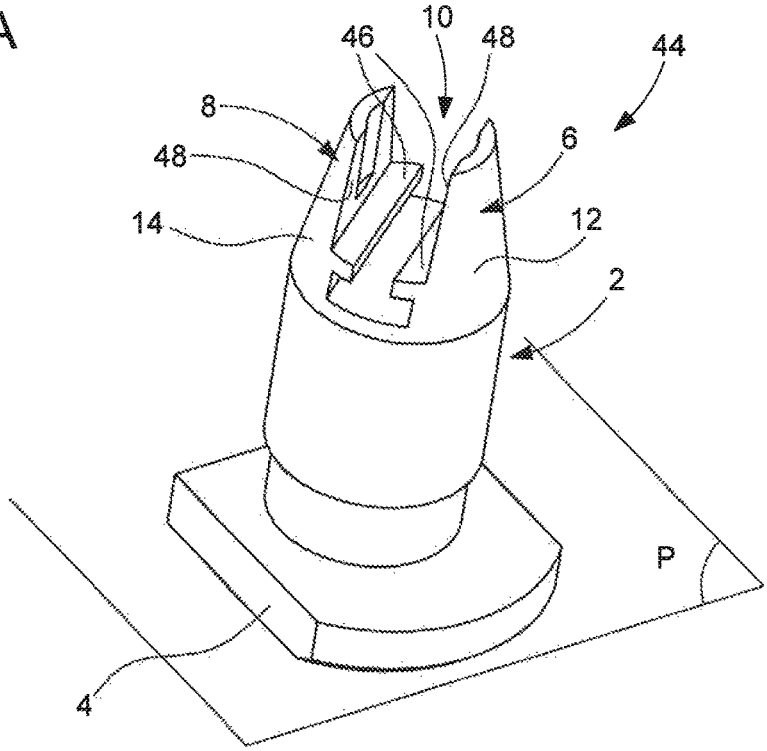
FIG. 3A is a perspective view of a third embodiment of the invention in which a bead formed on each of the facing internal lateral surfaces of the first and second arms of the balance-spring stud according to the invention project in the gap.

Designated overall by the general numerical reference 44, a third particular embodiment of a balance-spring stud 2 according to the invention is shown in FIG. 3A appended to the present patent application. In accordance with this third particular embodiment 44 of the invention, the stop means projects in the gap 10 provided for receiving the hardened spot of glue 16 in which the free end 18 of the last turn on the outside of the spiral spring 20 is trapped. By way of example that is illustrative and non-limitative only, the stop means is in the form of a bead 46 made in one piece with each of the internal lateral surfaces 48 that face each other of the first and second arms 6 and 8. It will be understood clearly that, once the spot of glue 16 in which the free end 18 of the last turn on the outside of the spiral spring 20 is trapped hardens, the beads 46 that project in the gap 10 definitively prevent the spot of glue 16 from escaping from this gap 10 should it come to be detached from the balance-spring stud 2.

Figure 3B:
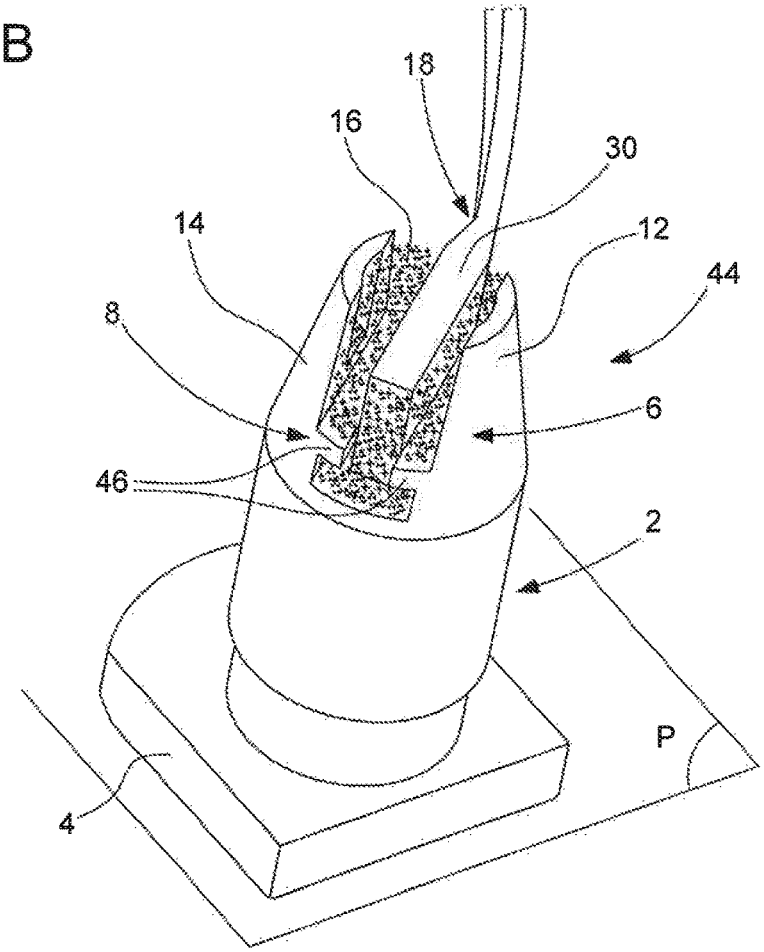
FIG. 3B is a view similar to the one in FIG. 3A, on which a silicon spiral spring can be seen, the free end of the last turn on the outside of which is fixed to the balance-spring stud by means of a spot of glue.

FIG. 3B is a view similar to the one in FIG. 3A, in which the silicon spiral spring 20 can be seen, fixed by the free end 18 of its last turn on the outside to the balance-spring stud 2 by means of a spot of glue 16.

Figure 4A:
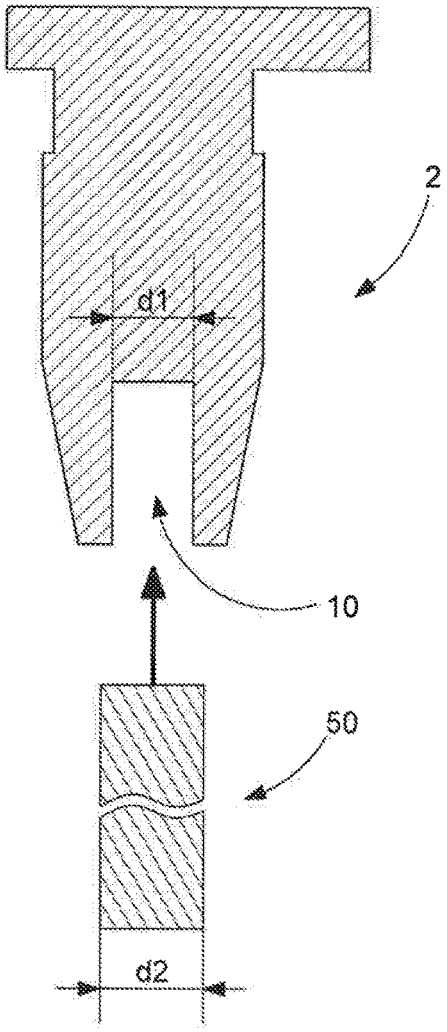
FIGS. 4A and 4B illustrate schematically a first variant of the method for machining beads on the facing internal lateral surfaces of the first and second arms of the balance-spring stud.
Figure 4B:
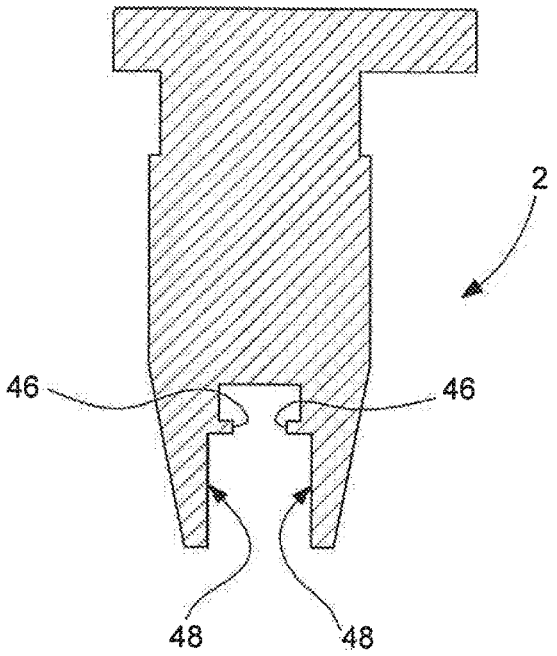

One possible technique for producing the beads 46 is illustrated in FIGS. 4A and 4B. This technique consists of procuring a balance-spring stud 2 having a gap 10 the initial width of which is d1, and then introducing into this gap 10 a stamping tool 50 the width d2 of which is greater than the width d1 and corresponds to the final width of the gap 10 sought. By forcing the stamping tool 50 into the gap 10, material is driven and a bead 46 is created on each of the internal lateral surfaces 48 of the first and second arms 6, 8. It should be noted that the beads 46 correspond to a preferred but non-limitative embodiment of the invention. This is because, in order to obtain a stop means projecting in the gap 10, it may also be envisaged, for example, piercing at least one of the two arms 6, 8 right through, and then introducing into the orifice thus obtained a pin that projects in the gap 10.

Figure 5A:
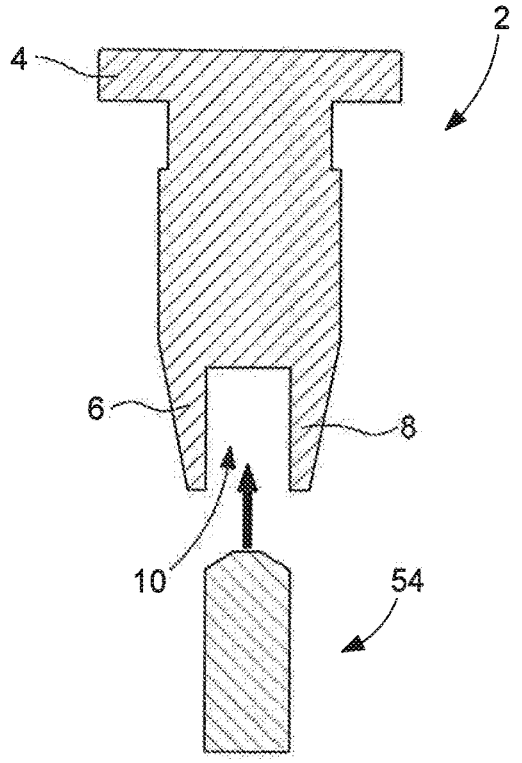
FIGS. 5A to 5D illustrate schematically a second variant of the method for machining beads on the facing internal lateral surfaces of the first and second arms of the balance-spring stud.
Figure 5B:
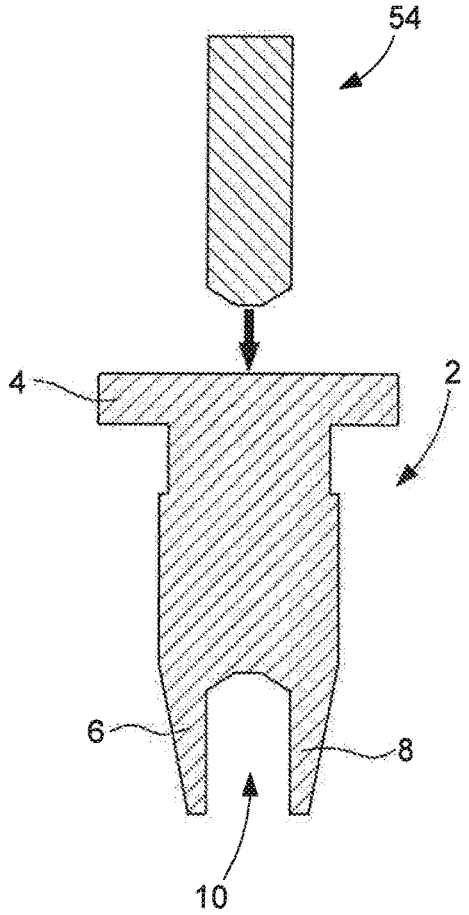
Figure 5C:
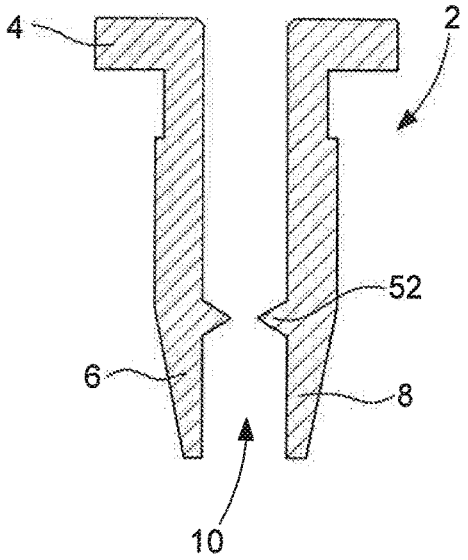
Figure 5D:
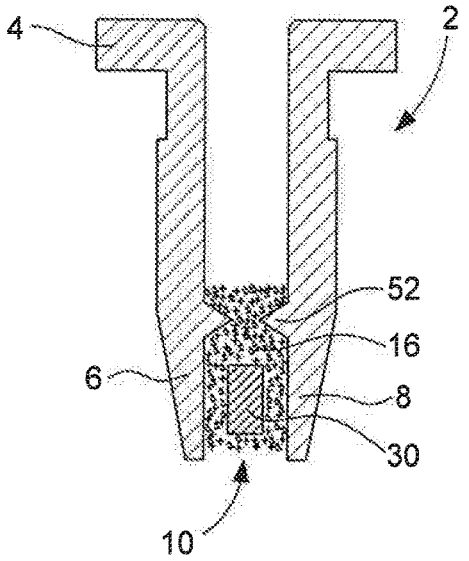

Another possible technique for creating an annular collar 52 is illustrated in FIGS. 5A to 5D. This technique consists of procuring a balance-spring stud 2 having a gap 10 and then introducing into this gap 10 a piercing tool 54 the end of which is conical. By advancing the piercing tool 54 into the gap 10 from the free end of the arms 6, 8 towards the base 4, a first hole 56 is created in the balance-spring stud 2 (FIG. 5B). Conversely, a second hole 58 is machined in the balance-spring stud 2 from the base 4 towards the free end of the first and second arms 6, 8 (FIG. 5A). The machining is carried out so that the second hole 58 emerges partially in the first hole 56, locally preserving the annular collar 52 on the internal lateral surfaces 48 of the first and second arms 6 and 8 (FIG. 5C). After having engaged the spiral spring 20 by the free end 18 of its last turn on the outside in the gap 10 and having deposited a drop of liquid glue, the latter is hardened so as to form a spot of glue 16 (FIG. 5D). The spot of glue 16 thus formed is held by the annular collar 52 so that, even if this spot 16 becomes detached from the balance-spring stud 2, it will be retained inside the gap 10, from which it will not be able to escape.

It goes without saying that the present invention is not limited to the embodiment that has just been described and that various simple modifications and variants can be envisaged by a person skilled in the art without departing from the scope of the invention as defined by the accompanying claims. In particular, in relation to FIGS. 6A and 6B, the method for bonding the free end of the last turn on the outside of the spiral spring to a balance-spring stud according to the invention is illustrated schematically. In FIG. 6A, the free end 18 of the last turn on the outside of the spiral spring 20 is disposed by its disc 30 in the gap 10 of the balance-spring 2 and is bonded by means of a drop of liquid glue 32 able to be polymerised by means of a source of ultraviolet radiation 34. This drop of liquid glue 32 is for example deposited by means of an automated distribution device 60 such as a syringe, also known by its English term dispenser. The exposure of the drop of liquid glue 32 to ultraviolet light allows polymerisation and complete hardening thereof. It should be noted that the example of the liquid glue polymerisable by exposure of ultraviolet light is given solely by way of example and that other types of liquid glue can be envisaged, such as a glue hardening in contact with the air.

INDEX

1. First particular embodiment
2. Balance-spring stud
4. Base
P. Plane
6. First arm
8. Second arm
10. Gap
12, 14. External surfaces
16. Spot of glue
18. Free end on the outside
20. Spiral spring
22. Hole
24. Free end on the inside
28. Collet
30. Disc
32. Drop of glue
34. Ultraviolet radiation source
36. Second particular embodiment
38. Groove
40. Hooks
42. Support surfaces
44. Third particular embodiment
46. Beads
48. Internal lateral surfaces
50. Stamping tool
d1. Initial width
d2. Final width
52. Annular collar
54. Piercing tool
56. First hole
58. Second hole
60. Glue dispenser

The invention claimed is:

1. A balance-spring stud for fixing, with a spot of glue, a free end of a last turn on an outside of a spiral spring for a timepiece movement, said balance-spring stud comprising:

a base that lies in a plane, and a first arm and a second arm that extend from the plane, free ends of the first and second arms being opposite to the base, wherein the first and second arms are separated from one another by a gap in which the free end of the last turn on the outside of the spiral spring that is trapped in a hardened spot of glue is housed, wherein at least one of the first arm and the second arm is provided with a stop means arranged to prevent the spot of hardened glue in which the free end of the last turn on the outside of the spiral spring is trapped from being released from the gap in which said spot of hardened glue is housed when said spot of hardened glue no longer adheres to the balance-spring stud, wherein the stop means projects in the gap receiving the spot of hardened glue in which the free end of the last turn on the outside of the spiral spring is trapped, and wherein the stop means is at least one bead that is made in one piece with the at least one of the first arm and the second arm.

2. A method for manufacturing a balance-spring stud for fixing a free end of a last turn on an outside of a spiral spring for a timepiece movement, wherein said balance-spring stud comprises a base that lies in a plan; and a first arm and a second arm that extend from said plane, the first and second arms being separated from one another by a gap intended to house the free end of the last turn on the outside of the spiral spring that will be trapped in a spot of hardened glue, the gap being initially produced with a first width, the method comprising:

widening the gap by stamping and creating, by upsetting, a stop means that projects in the gap designed to receive the spot of hardened glue in which the free end of the last turn on the outside of the spiral spring is trapped.

3. A method for manufacturing a balance-spring stud for fixing a free end of a last turn on an outside of a spiral spring for a timepiece movement, wherein said balance-spring stud comprises a base that lies in a plane and on which first and second arms, which each includes a free end opposite to the base, are erected, the first and second arms being separated from one another by a gap in which the free end of the last turn on the outside of the spiral spring that is trapped in a spot of hardened glue is housed, the method comprising:

machining a first hole in the balance-spring stud from the free end of the first and second arms towards the base, and machining a second hole in the stud from the base towards the free end of the first and second arms, the machining being carried out so that the first hole emerges partially in the second hole in order to locally preserve a collar that projects in the gap provided for receiving the spot of hardened glue in which the free end of the last turn on the outside of the spiral spring is trapped.

* * * * *